United States Patent [19]

Trolle

[11] 4,091,938

[45] May 30, 1978

[54] DEVICE FOR HANDLING LARGE WORKPIECES

[75] Inventor: Sten Trolle, Ystad, Sweden

[73] Assignee: AB Carbox, Ystad, Sweden

[21] Appl. No.: 703,641

[22] Filed: July 8, 1976

[30] Foreign Application Priority Data

Aug. 1, 1975 Sweden ..... 75 08727

[51] Int. Cl.[2] ..... B25J 11/00

[52] U.S. Cl. ..... 214/1 F; 100/215; 72/361; 214/1 S

[58] Field of Search ..... 72/361, 420, 421, 422, 72/428, 305, 295; 83/412; 214/1 F, 1 S, 1 BB, 1 BT; 269/8, 21; 100/144, 215

[56] References Cited

U.S. PATENT DOCUMENTS

| | | | |
|---|---|---|---|
| 2,638,662 | 5/1953 | Rothwell | 72/421 X |
| 2,741,481 | 4/1956 | Ortegren | 269/8 X |
| 2,990,305 | 6/1961 | Richardson | 269/21 X |
| 3,224,241 | 12/1965 | Dolney | 72/305 X |
| 3,364,723 | 1/1968 | Sartside | 72/421 X |
| 3,426,569 | 2/1969 | Brauer | 72/295 |
| 3,568,490 | 3/1971 | Bohmann | 72/305 X |

*Primary Examiner*—Leon Gilden
*Attorney, Agent, or Firm*—Flynn & Frishauf

[57] ABSTRACT

A machine for processing large workpieces, particularly a hydraulic press for working on large metal sheets, comprises external equipment for rigidly supporting and guiding the workpiece. The handling equipment is provided with means which permit the workpiece, together with part of the handling equipment, to carry out movements induced by the reactional forces generated in the workpiece by the tools of the machine. Those forces are held within predetermined limits, whereby the handling equipment is protected against damage but still capable accurately to position the workpiece relative to the tools before each processing step carried out by the tools.

10 Claims, 2 Drawing Figures

DEVICE FOR HANDLING LARGE WORKPIECES

The present invention relates to a device for handling large workpieces, especially metal sheets which are to be treated in a press provided with a handling apparatus supporting the workpiece outside the press during its treatment by the press tools.

The prior art includes of several types of apparatus for the use mentioned. However, all of them have certain operational limitations which have reduced their capability to handle workpieces in the shape of large metal sheets. The term "large" has been used here in two different meanings. In one sense it refers to metal sheets which are unwieldy due to their absolute dimensions and the corresponding heavy weight. In its other sense it refers to metal sheets which are thin and slim in the sense that their surface is large relatively to the thickness. This means that they are unwieldy due to lack of stiffness rather than in consequence of the size. As will appear from the description below, application of the present invention is especially valuable when both those situations are present simultaneously. However, the presentation of the invention will also clearly indicate that the invention yields substantial technical advantages also in such cases where the workpieces can be described either as being only very big and heavy, i.e. the stiffness is not especially low, or when neither the size nor the weight of the workpieces causes the significant handling problems which are instead the result of the overall rigidness being so low that it becomes difficult to support the workpiece.

The handling problems above referred to are basically two. The first problem relates to the difficulty of adequately supporting and handling the workpiece before, during and after the treatment thereof in the press or corresponding machine. The second problem is how to establish and exact orientation of the workpiece relative to the tools of the machine, especially when a given workpiece is to be treated in a plurality of successive steps. Workpiece handling equipment is known which is capable of solving either of those two problems separately. On the other hand, the prior art does not include any equipment which can simultaneously satisfy both requirements and the object of the invention is to provide such an equipment.

A classical method of handling large metal sheets to be treated plastically in a machine, e.g. a hydraulic press, involves that the sheet, which is normally rectangular, is suspended by wires connected to each of its four corners. The top ends of the wires are connected to the lifting hooks of overhead cranes which can travel along beams mounted above the press. Provided that the two cranes can be driven substantially in synchronism this provides a simple way of moving the workpiece into different positions relative to the press so that the workpiece can successively be treated at a plurality of separate spots. During such a treatment the positions of those portions of the sheet which are located outside the press are naturally changed, normally vertically as well as horizontally. Those movements are, however, absorbed by the flexible wires which means that the reactional forces transmitted to them will not affect the cranes or any other parts which could be damaged. Stated in other words, the protection of such a handling equipment has been achieved by avoidance of rigid mechanical connections between the workpiece and the parts of the equipment determining the position of the workpiece. The absence of such stiff connections does, however, on the other hand involve the most serious disadvantage that the position of the workpiece cannot be positively and accurately controlled by a corresponding movement of the handling equipment. Stated in other words, this entails the practical shortcoming that one cannot by moving each of the cranes into predetermined positions cause the workpiece to reach a corresponding, accurately determined position. Therefore, it has been necessary before the introduction of each working step to visually determine the position of the workpiece relative to the tools of the press and, to the extent necessary, to adjust that position.

It follows from what has been said above that prior art workpiece handling equipment cannot be modified for remote control of the working treatment which is a desideratum also in the heavy mechanical industry. By way of example, let us consider the treatment of large metal sheets for use in the shipbuilding industry. The length of such a sheet is typically 10–15 m and the width 3–6 m. When such sheets shall form parts of the hull of a ship, they are very often curved in two mutually perpendicular directions and, under all circumstances, each sheet must be subjected to several treatments at different spots. A requirement for automatic handling is that the position of each spot on the sheet can be continuously determined expressed as its distance from some stationary point, e.g. a part of the handling equipment. However, to date, the following two requirements have been considered to be incompatible: to maintain a rigid connection between the handling equipment and the workpiece making such a position determination possible; and to protect the handling equipment from being damaged by reactional forces caused by the movements carried out by the workpiece during its treatment in the press. In this context it should be observed that, in the cases when those reactional forces have been mastered in the way that the handling equipment has been capable of absorbing them, there has instead appeared another equally unacceptable situation, namely that the rigid retainment of the workpiece has resulted in an undesired permanent deformation of the portions thereof located outside the press.

SUMMARY OF THE INVENTION

As has been indicated above, the main object of the present invention is to provide a handling equipment for large workpieces which is capable of simultaneously satisfying the two requirements so far considered incompatible. According to the principle characteristic of the invention this has been achieved by the use of means causing the handling equipment to such an extent to absorb the reactional movements carried out by the external portions of the workpiece that the forces generated by said movements and affecting the handling equipment are kept within predetermined limits.

A further problem appearing in the treatment of large metal sheets can be exemplified in the following way. A metal sheet, for example steel, which has the per se substantial thickness of 20 mm will, if its other dimensions are say 4 times 12 m, appear as a thin sheet. This introduces the problem of protecting it from being unintentionally deformed not only by external forces but also due to its own weight, by way of example when it is treated adjacent to its one end or its center so that substantial portions of the sheets overhang one or both edges of the working table of the press. A particular object of the invention has been to solve this special problem as well.

BRIEF DESCRIPTION OF THE DRAWINGS

One embodiment of the invention will now be described in greater detail, reference being made to the accompanying diagrammatic drawing.

DETAILED DESCRIPTION

Figure 1:
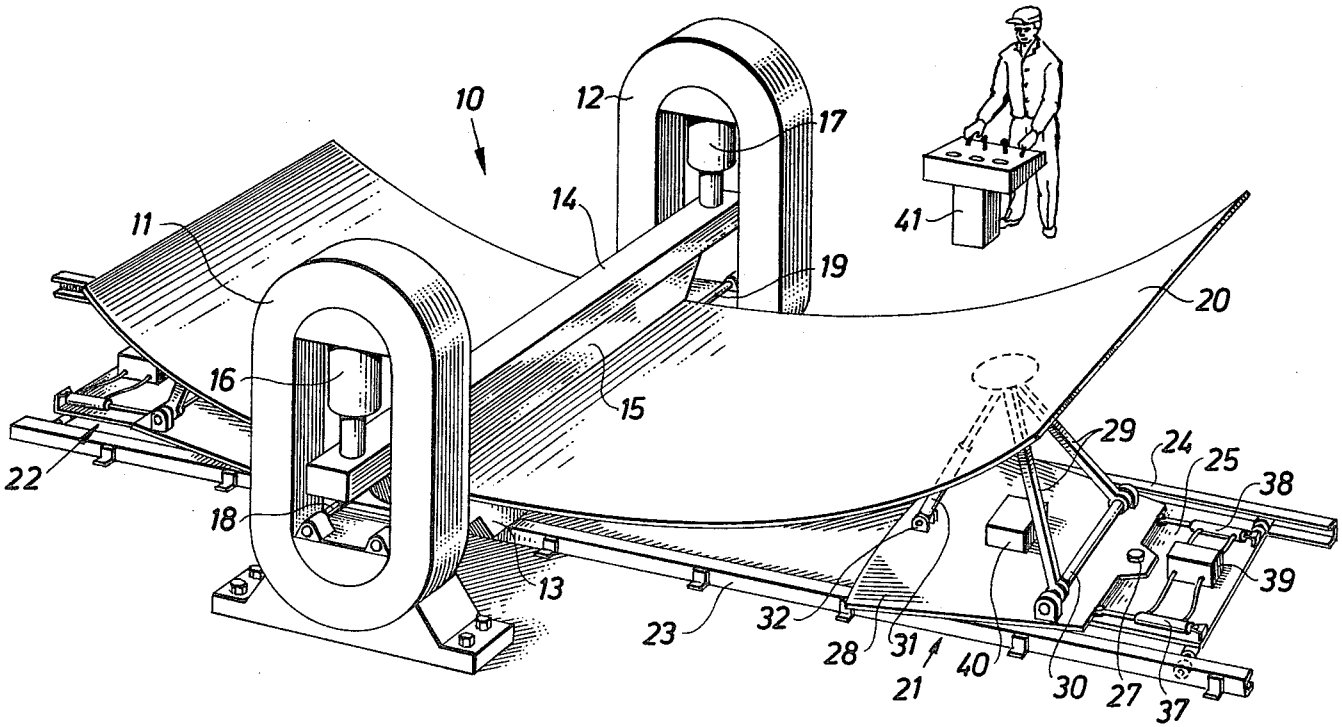
FIG. 1 is a perspective view showing a hydraulic press provided with a handling equipment according to the invention.

Reference numeral 10 designates the hydraulic press which, according to the illustrated embodiment, is adapted for treating workpieces in the form of large metal sheets. The press has a frame comprising two columns 11 and 12. As appears from the drawing, each of those columns is double and comprises of two vertical legs which together with upper and lower yokes form an oval structure. Those structures serve as supports for a great number of turns of tension-biased steel wires. This arrangement significantly increases the capability of the press frame to absorb the reactional forces generated during the pressing operation. It should be observed that the corresponding arrangement does not form any part of the present invention but belongs to the prior art.

The two double columns 11 and 12 are bridged by a horizontal working table 13 above which there extends a transversal beam 14 carrying a press tool 15 which can be raised and lowered by means of two hydraulic cylinders 16 and 17, each cylinder being mounted at one end of beam 14. Along the two transversal sides of the press table 13 there extend feeder rollers 18 and 19 which are idle and the purpose of which is to facilitate the passage of the workpiece through the press.

Figure 2:
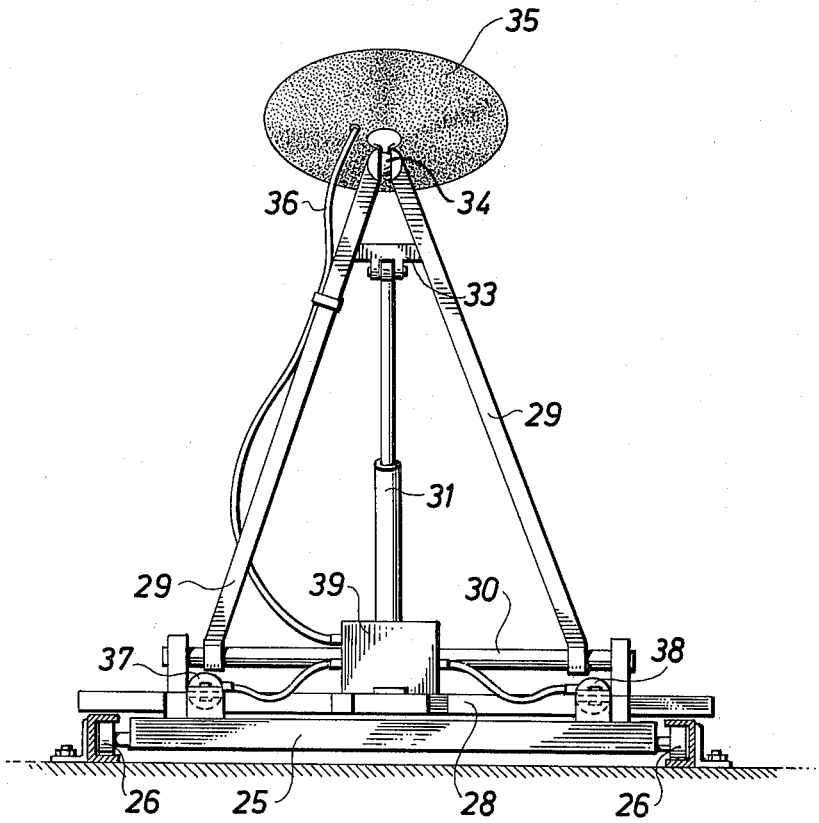
FIG. 2 is an end view illustrating the one half of the handling equipment.

The workpiece is in this case a large metal sheet 20 which outside the press is supported by a handling equipment comprising two units 21 and 22. The latter are movable towards and from the press along rails 23, 24. The more detailed constructional nature of the handling apparatus appears from FIG. 2.

Each unit 21, 22 has a substantially rectangular chassis frame supporting the various components of the unit. In the illustrated example (see FIG. 2) frame 25 has a number of wheels 26 fitting between the top and bottom flanges of the rails the cross-sectional profile of which is that of a U-beam resting on its own flange. As is understood, the arrangement described means that each of the two handling units 21, 22 can easily be displaced in the longitudinal direction of the rails 23, 24 but is securely protected against tilting movements. It should, however, be stressed that the corresponding structure only constitutes one of several equivalent solutions. By way of example, the handling units do not have to be provided with wheels. Instead, they can be slidable along guides or similar means.

Reference numeral 27 refers to a vertical pivot carried by frame 25 and supporting a platform 28 swingable in the lateral direction. Two supporting legs 29 converging upwards are mounted for swinging movement around a horizontal transverse shaft 30 carried by the platform 28. Their swinging movement is controlled by a double-acting hydraulic cylinder 31 the bottom end of which is articulated to a bracket 32 on the platform, whereas its top end is pivotably connected to a cross-beam 33 adjacent to the top ends of legs 29. The legs are at their tops terminated by a ball and socket joint 34 supporting a suction cup 35. As shown on the drawing, cup 35 is intended to contact the bottom of sheet 20 and to retain it by suction. The necessary vacuum is generated by any suitable means (not shown) and conveyed through a hose 36.

Frame 25 supports two hydraulic cylinders 37 and 38 for swinging the platform 28 about pivot 27. Cylinders 37 and 38 are also double-acting and via hoses connected to a hydraulic unit 39. Numeral 40 designates another such unit to which cylinder 31 and suction cup 35 are connected.

According to the illustrated embodiment the handling equipment comprises two units 21, 22 mounted at either side of press 10. Each of the two units 21, 22 is, like the press proper, controlled from a control desk 41. The operation of the arrangement is as follows.

According to FIG. 1 a workpiece 20 in the shape of a large metal sheet is under treatment in press 10. It is at each side of the press supported by handling units 21 and 22 the suction cups of which contact the bottom of the sheet. It should be observed, and will below be described, that the corresponding retainment of the workpiece is different during the active and passive phases of the press. A complete working cycle is as follows.

The first operational step involves that sheet 20 is transported to the press. This transport can in many cases take place by means of handling units 21, 22. When the workpiece 20 has been guided into the gap of the press and positioned there for the first treatment step the hydraulic equipment is switched to another operational mode in which the workpiece is retained at a relatively insignificant margin only. The corresponding switching can take place e.g. by activation of by-pass valves and pressure accumulators keeping the working pressures in the different hydraulic cylinders at substantially constant values. More particularly, each pressure should be kept within a range defined by an upper and a lower limit. This signifies that if the handling equipment is via the workpiece subjected to external forces causing such changes of the hydraulic pressures that those limits are exceeded, then the pressure accumulators or the by-pass valves, respectively, will be activated and maintain the pressure values within the predetermined ranges. On the other hand, the pressure is permitted to vary within those limits which means that the suction cups have a certain restricted freedom of movement.

When the press has been started up and a pressing operation initiated, the forces which are transmitted to the handling units 21, 22 via the press and the workpiece cannot damage those units. The invention has thus made it possible to use handling equipment which, as a matter of principle, is completely rigid in contrast to chains, wires and similar devices but which still does not require any overdimensioning in order to resist the generated stresses. Second, the workpiece is protected against permanent plastic deformation and, third, there is no risk that the suction cups will slide along the surface of sheet 20. Such a sliding movement would naturally mean that the position of the sheet with reference to the handling equipment would no longer be known. This would, stated in other words, mean that it would not be possible using the handling equipment only to exactly position the workpiece before the next working step.

In order to still more clearly illustrate the practical significance of the operation of the above discussed apparatus, it should be added that when a metal sheet is treated under conditions here at issue the generated reactional forces will tend not only to raise or lower the end portions of the sheet external to the press. In addition thereto, the sheet has a tendency to get twisted both around its longitudinal axis and around an axis perpendicular to its plane. The first-mentioned movement is absorbed by the ball and socket joints 34 and the other movement is absorbed by virtue of the fact that platform 28 can swing relative to the frame 25 meaning that hydraulic cylinders 37 and 38 are overmanned to the extent necessary.

When a given treatment step has been concluded and the workpiece shall be positioned for the next step, the hydraulic system is again switched to its initial mode in which a completely rigid control of the workpiece is achieved. The corresponding positioning of the workpiece can be carried out not only at a great accuracy but also at a much higher speed than when conventional arrangements are used. The increased adjustment speed is due to the fact that the pendulum phenomena have been eliminated which are compulsory when the workpiece is suspended in wires or chains. The accuracy of the positioning is a result of the fact that the suction cups — or corresponding gripping means — can always be mounted in predetermined positions relative to the workpiece. Further, since their positions in all the three dimensions can easily be determined with reference to, by way of example, an arbitrary point on the frame of each handling unit, what remains is only to determine the position of the last-mentioned point relatively the press. Such a determination does not offer any difficulties at all. The handling equipment can be controlled by means of a minicomputer. In such a case the first workpiece of a given type or, alternatively, the first workpiece to be subjected to a treatment made up of certain working steps, is positioned manually and each position visually supervised. At the same time information concerning those positions is fed into the computer, whereby the latter is programmed so that successive workpieces within the same series can be treated fully automatically. In many applications it is especially valuable that, disregarding the accuracy in absolute terms, any and all deviations from the nominal dimensions will be reproduced in all workpieces within the series, meaning that all finished products are identical and can be exchanged between themselves.

Finally, it should be emphasized that this specification and the drawings are intended only diagrammatically to illustrate the inventive concept and should not be interpreted in a limiting sense. The essential characteristic is that the flexible suspension devides have been replaced by rigid handling units designed in such a way that the advantages above discussed are realized-above all the great accuracy, the increased repositioning speed and the protection against damage of the handling equipment or deformation of the workpiece. The gripping means have been shown as suction cups but, as is understood, electromagnetic gripping means or any other suitable device can be used. The workpieces do not need to be in the shape of metal sheets and the machine does not have to be a press.

What is claimed is:

1. Handling apparatus for a machine for processing large workpieces, such as a hydraulic press for working metal sheets supported by a handling apparatus external to the machine, comprising:

means defining a processing station;

at least one horizontally displaceable platform which is horizontally displaceable towards and away from said processing station;

guide means coupled to said platform for restricting its displacement movements to horizontal displacements relative to said processing station;

said platform being further swingable in a horizontal plane;

support means mounted on said platform for non-slidingly engaging a surface of the workpiece and for supporting at least a portion of the workpiece;

means including hydraulic means coupled to said support means for controlling at least the vertical position of support of the workpiece and for absorbing the reactional movements carried out by the portions of the workpiece supported by the handling apparatus in response to the processing by the machine;

means coupled to said hydraulic means for sensing the working pressure in said hydraulic means and for regulating the pressure in said hydraulic means in response to the sensed pressure values to maintain the pressure in said hydraulic means within a predetermined range;

further hydraulic means coupled to said platform for swinging said platform in said horizontal plane; and means coupled to said further hydraulic means for sensing the working pressures in said further hydraulic means and for regulating the pressures in said further hydraulic means in response to the sensed pressure values to maintain said pressures in said further hydraulic means within predetermined ranges;

thereby supporting said workpiece with a restricted freedom of movement of said support means.

2. Apparatus according to claim 1, wherein said support means comprises suction cup means for non-slidingly engaging a surface of the workpiece.

3. Apparatus according to claim 1, wherein said hydraulic means and said further hydraulic means each comprise at least one hydraulic cylinder.

4. Apparatus according to claim 3, wherein said hydraulic cylinder for controlling at least the vertical position of support of the workpiece is pivotally mounted to said platform and is further pivotally mounted to said support means.

5. Apparatus according to claim 4, wherein said means including said hydraulic cylinder for controlling at least the vertical position of support fo the workpiece comprises a frame member pivotally mounted to said platform at a position on said platform spaced from said pivotal mounting of said hydraulic cylinder, said frame member being pivotally mounted to said support means.

6. Apparatus according to claim 5, wherein said frame member is a triangular frame, the apex of said triangular frame being pivotally mounted to said support means and the base of said triangular frame being pivotally mounted to said platform, said base being mounted transverse to the horizontal direction of movement of said platform.

7. Apparatus according to claim 1, wherein said support means comprises magnet means for non-slidingly engaging a surface of the workpiece.

8. Apparatus according to claim 1, comprising a further horizontally displaceable platform swingable in a horizontal plane about a substantially vertical axis, and associated guide means, support means, hydraulic means, further hydraulic means and sensing means mounted spaced from the first-mentioned platform with said processing station interposed therebetween.

9. Apparatus according to claim 1, wherein said platform is swingable in said horizontal plane about a substantially vertical axis.

10. Apparatus according to claim 9, wherein said further hydraulic means comprises a pair of hydraulic cylinders, each located on opposite sides of said substantially vertical axis.

* * * * *